US006393784B1

(12) United States Patent
Antekeier

(10) Patent No.: US 6,393,784 B1
(45) Date of Patent: May 28, 2002

(54) CORNER PIECE FOR CARPET MOLDING

(75) Inventor: Mark Antekeier, Grand Rapids, MI (US)

(73) Assignee: Wabasys Products Corporation, Grand Rapids, MI (US)

( * ) Notice: Subject to any disclaimer, the term of this patent is extended or adjusted under 35 U.S.C. 154(b) by 0 days.

(21) Appl. No.: 09/602,526

(22) Filed: Jun. 9, 2000

(51) Int. Cl.[7] ..... E04B 2/00

(52) U.S. Cl. ..... 52/287.1; 52/288; 52/287; 52/11; 52/58; 52/95; 52/16; 52/94; 52/96

(58) Field of Search ..... 52/288, 287.1, 52/287, 11, 58, 95, 16, 94, 96

(56) References Cited

U.S. PATENT DOCUMENTS 4,186,531 A * 2/1980 Okolischan ..... 52/288
5,088,252 A * 2/1992 Antekeier ..... 52/288
6,212,836 B1 * 4/2001 Larson ..... 52/287.1
6,241,205 B1 * 6/2001 Affrunti ..... 52/287.1

* cited by examiner

*Primary Examiner*—Carl D. Friedman
*Assistant Examiner*—Chi Q. Nguyen
(74) *Attorney, Agent, or Firm*—Sughrue Mion, PLLC

(57) ABSTRACT

A corner piece is provided for an external corner of a wall structure for use with baseboard channel members adapted to have carpet strips mounted thereon. The corner piece has an external cylindrical configuration extending between two side walls perpendicular to each other. An inner surface of the corner piece is formed by a notch defining two walls perpendicular to each other and perpendicular to the side walls, respectively. A pair of flanges are integrally molded with the corner piece and extend outwardly perpendicular to the side walls of the corner piece for engagement in complementary cut-out portions of a carpet channel member.

4 Claims, 6 Drawing Sheets

CORNER PIECE FOR CARPET MOLDING

BACKGROUND OF THE INVENTION

The present invention is directed to a corner piece for carpet molding and more specifically, to a corner piece compatible with an existing baseboard channel member for holding pre-cut carpet strips.

The existing baseboard channel member for pre-cut carpet strips is the subject of Applicant's U.S. Pat. No. 5,088,252 granted Feb. 18, 1992. Such a member is comprised of an elongated extruded resilient plastic channel member having a flat rear wall for mounting on a vertical building wall. The flat rear wall terminates at upper and lower longitudinal edges in an integral generally L-shaped lower wall and an integral reversely directed arcuate upper wall. Both the upper and lower walls project outwardly and away from the rear wall and define therebetween upper and lower slots for receiving the upper and lower longitudinal edges of a decorative pre-cut carpet strip which is slidably inserted therein.

When using the existing baseboard channel member, difficulties have arisen with respect to inside and outside corners of the walls upon which the baseboard channel members are mounted. The greatest difficulty exists with respect to outside corners where it is necessary to miter the baseboard channel members in order to obtain a smooth neat looking appearance. However, when using carpet strips having a substantially thick texture, such as Berber carpets, it is difficult to wrap such carpeting around the outside corners defined by two baseboard channel members abutting each other at 90 degrees.

SUMMARY OF THE INVENTION

In order to solve the foregoing problems, the present invention is directed to a corner piece for carpet molding, specifically the baseboard channel members for receiving pre-cut carpet strips. The use of the corner piece according to the present invention eliminates the need for a mitered cut and the bending of the carpet at 90 degrees.

The present invention provides a corner piece for carpet molding having a height substantially equal to the height of the baseboard channel members and having a rounded, vertically disposed outer surface and two vertically disposed flat surfaces disposed orthogonally with respect to each other with an elongated notch on the inner surface between the two flat surfaces. The notch is adapted to fit closely over the outer surfaces of two walls disposed at right angles to each other so that the two flat surfaces will be disposed perpendicular to the two walls respectively. A pair of attachment flanges extend outwardly from each flat surface at right angles to each other to facilitate securement of the corner piece to the two walls. The conventional baseboard channel member may be provided with a cut-out in the flat rear wall complementary to the flange so that the exterior surface of the flange will be flush with the exterior surface of the baseboard channel member. The ends of the baseboard channel members mounted on each wall can abut smoothly against the flat surfaces of the corner strip.

Further objects and advantages of the present invention will become apparent from a consideration of the drawings and ensuing description and operation.

DETAILED DESCRIPTION OF THE INVENTION

Figure 1:
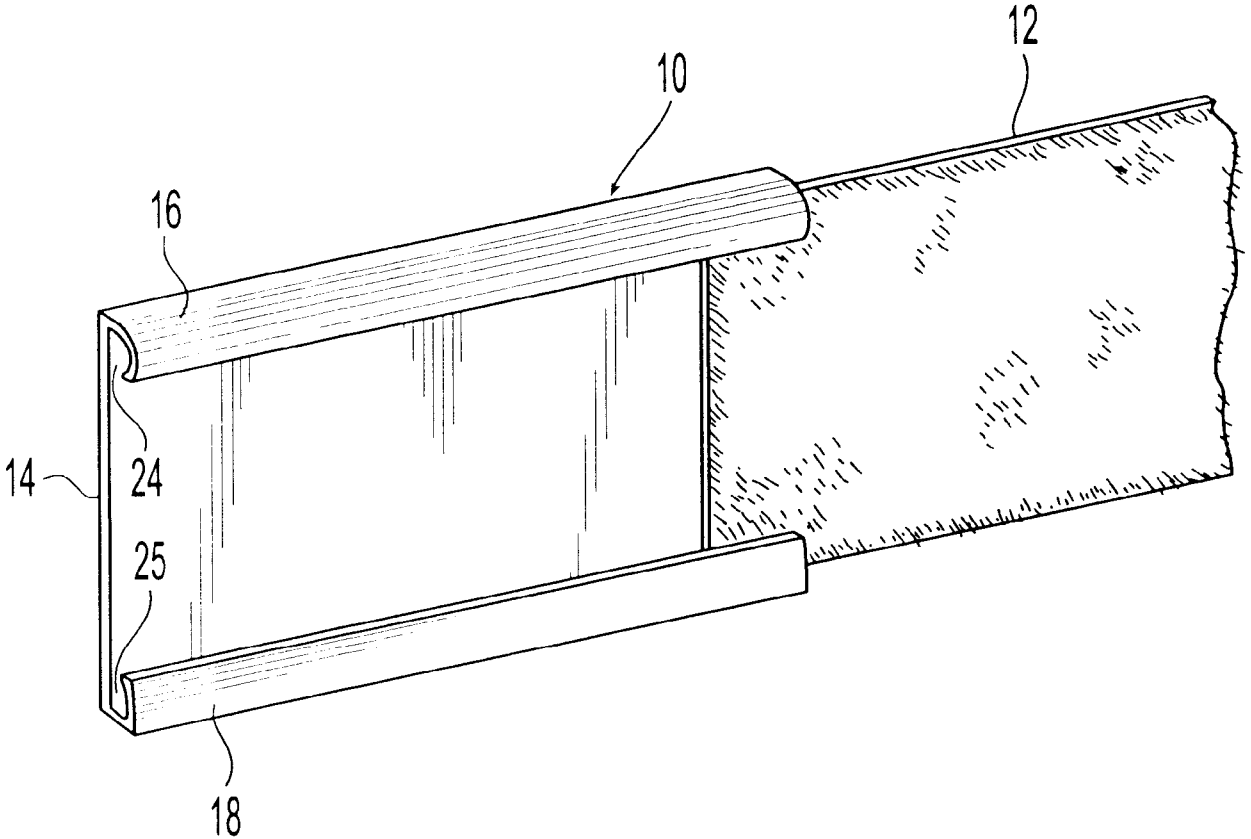
Fig. 1 (Prior Art)
FIG. 1 is a perspective view of the previously known baseboard channel member with a pre-cut carpet strip partially inserted therein.
Figure 2:
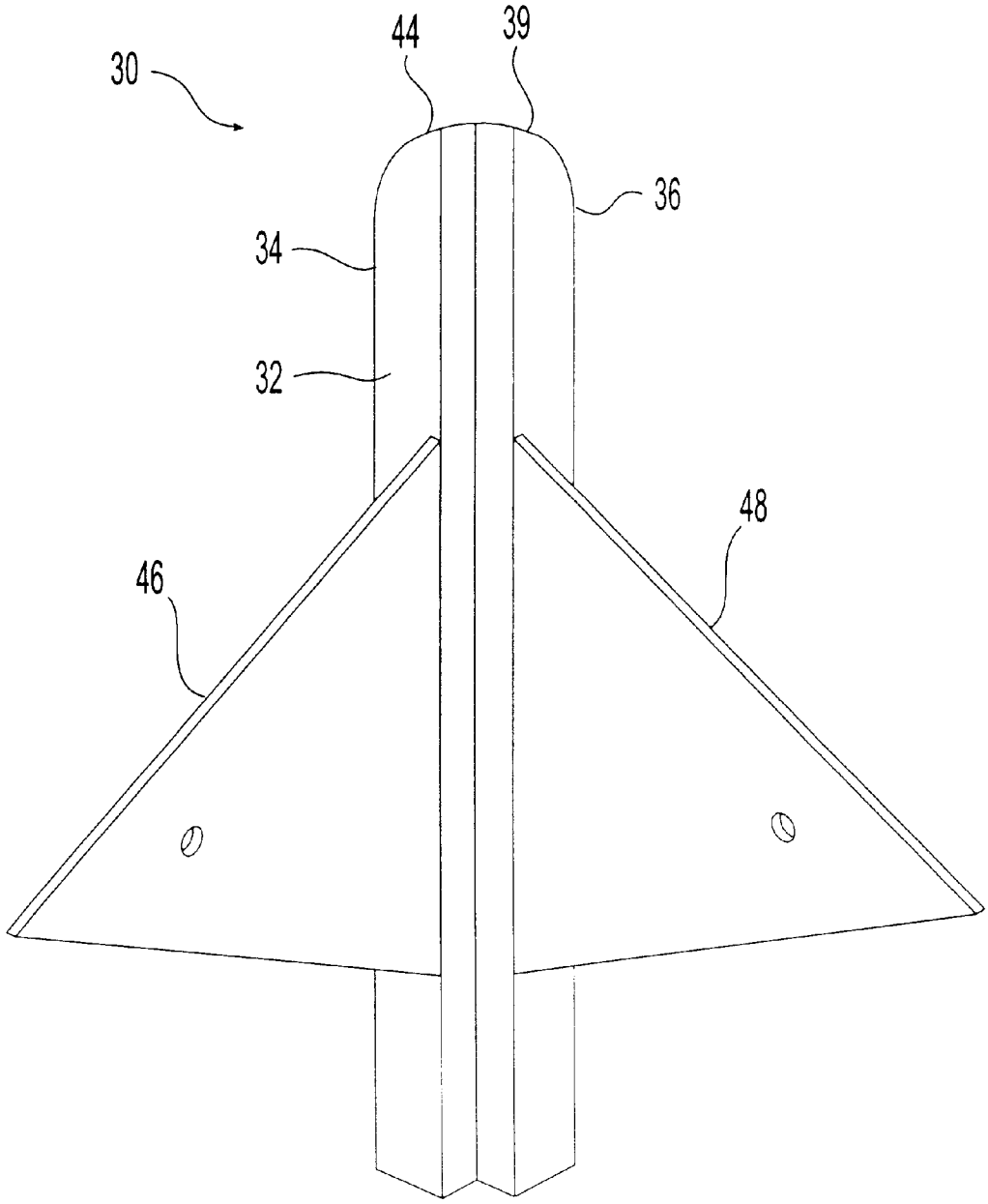
FIG. 2 is a rear perspective view of a corner piece according to the present invention.
Figure 3:
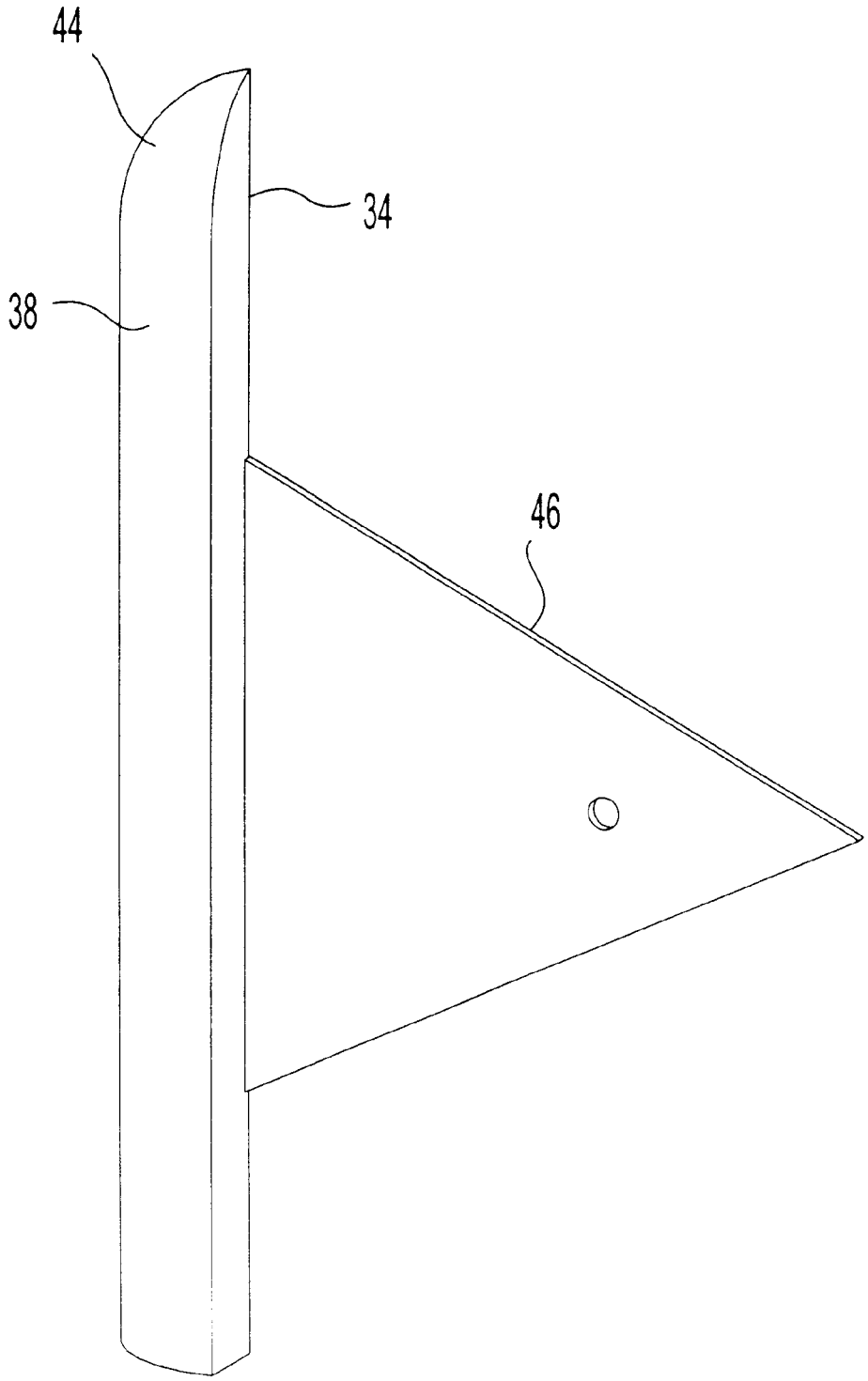
FIG. 3 is a perspective side view of the corner piece according to the present invention.

The baseboard channel member 10 was the subject of Applicant's prior U.S. Pat. No. 5,088,252. It was designed for slidably receiving a correspondingly sized carpet strip 12 having a longitudinal dimension or length sized to that of the channel member 10 having a transverse width and overall thickness matching the channel dimensions of the member 10. The baseboard channel member 10 is preferably of extruded plastic material such as PVC and the extrusion is comprised of a vertical rear wall 14, an integral, reversely directed or bent, arcuate, outwardly projecting upper wall 16 and an integral, outwardly projecting L-shaped lower wall 18 forming oppositely facing top and bottom grooves or slots 24 and 26, respectively. The entire disclosure of U.S. Pat. No. 5,088,252 is incorporated herein by reference.

Figure 4:
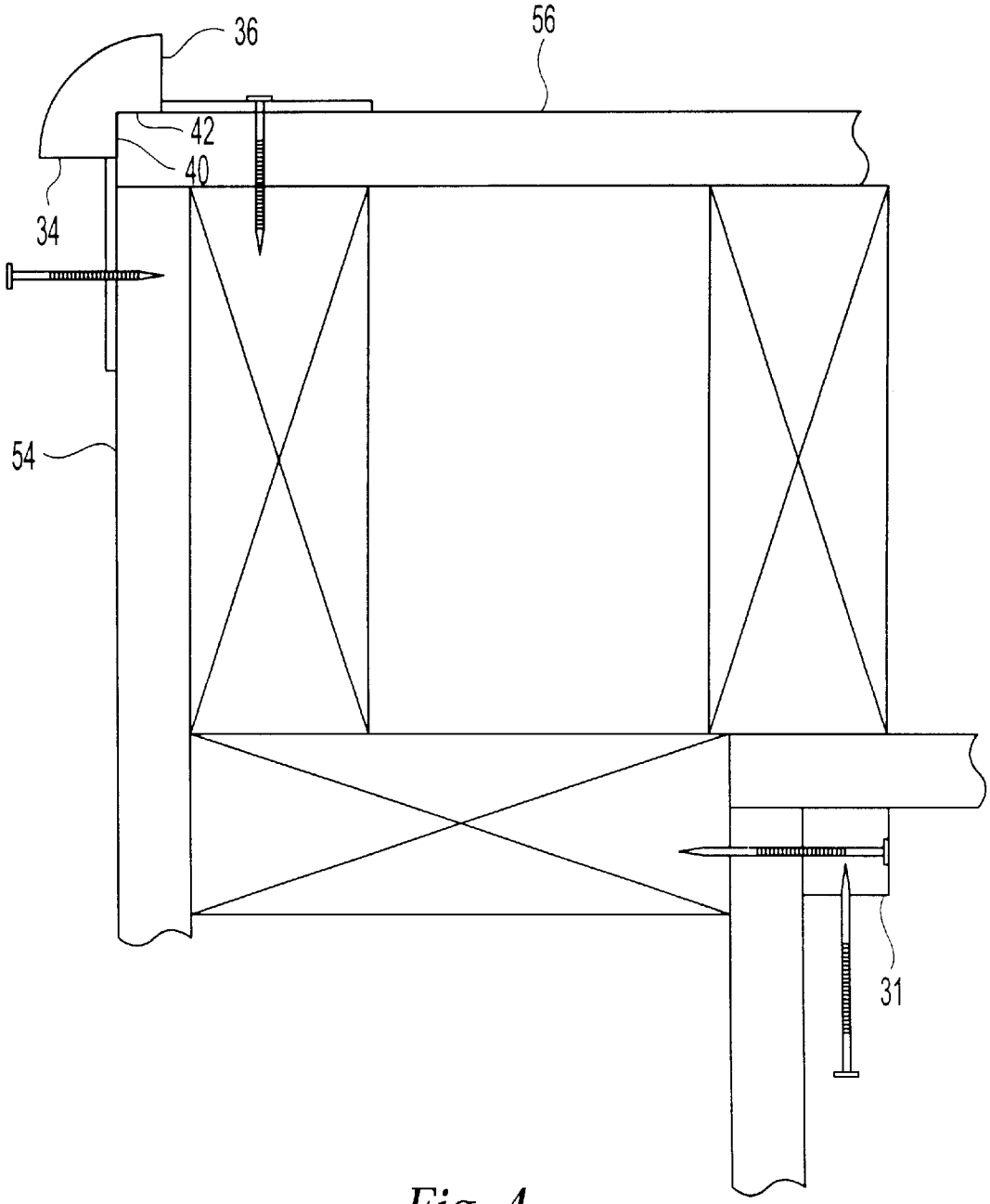
FIG. 4 is a sectional view of a typical corner assembly for a 2X stud wall with ½ inch drywall with the corner piece according to the present invention secured to the outside corner.

The corner piece of the present invention was designed to eliminate the need for mitering the end edges of the baseboard channel member. The corner piece 30 is a molded plastic member of PVC or the like and is comprised of a partial cylindrical member having two flat side surfaces 34 and 36 disposed at 90 degrees relative to each other and an external cylindrical surface 38 defining the outer surface of the corner piece and extending through an arc of 90 degrees. The inner face of the corner piece is defined by a right angle notch extending the length of the corner piece and having flat inner surfaces 40 and 42 disposed perpendicular to each other and to the flat sides 34 and 36. The top surface of the corner piece is rounded off and blends smoothly into the outer cylindrical surface 32. A pair of triangular flanges 46 and 48 are integrally molded with the main body of the corner piece and extend outwardly from the flat side walls 34 and 36, respectively and are disposed perpendicular thereto. The inner surfaces of the flanges 46 and 48 are flush with the inner surfaces 40 and 42, respectively. As a result, the corner piece as well as the flanges, are disposed in smooth, flat engagement with the corner wall surfaces 54 and 56 as best seen in FIG. 4.

Figure 5:
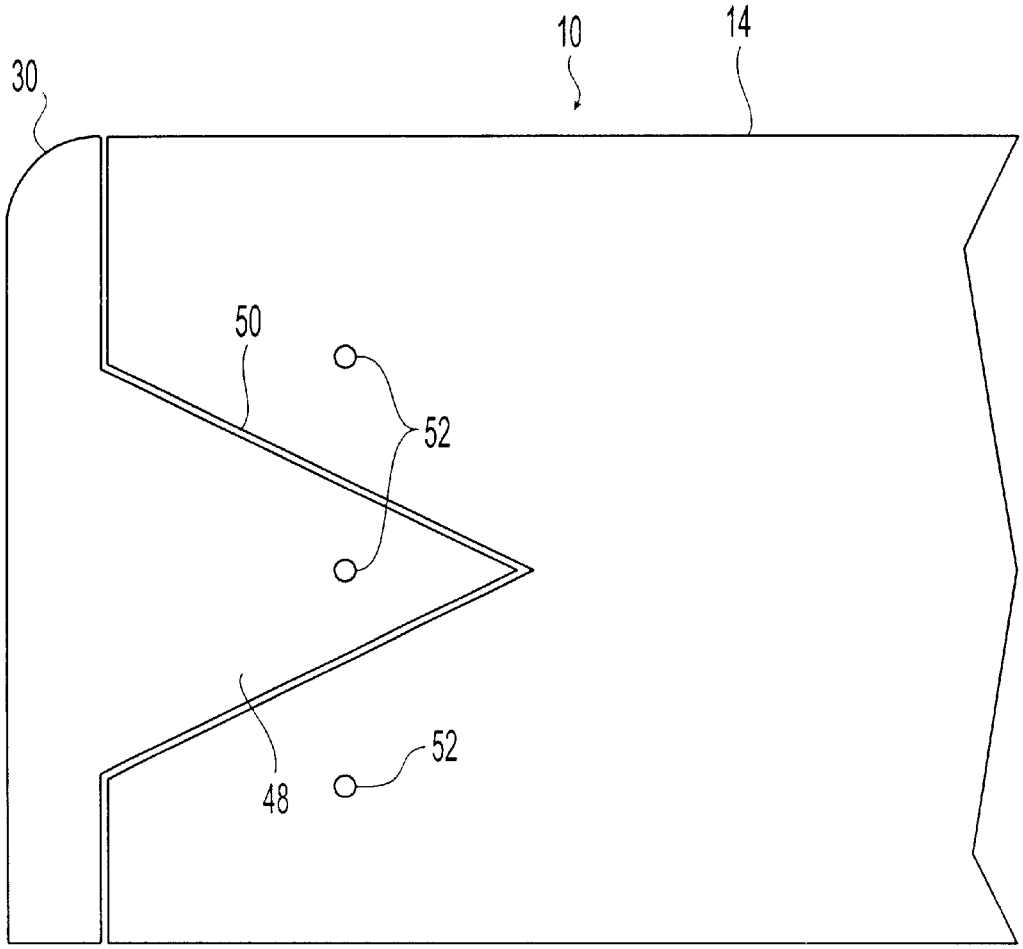
FIG. 5 is an elevational view of the conventional baseboard channel member of FIG. 1 in combination with the corner piece of the present invention wherein the rear wall of the baseboard channel member has been notched to receive the flange of the corner piece.

In order to mate the conventional baseboard channel members 10 with the corner piece 30, a triangular notch 50 is formed in the rear wall 14, which is identical to the triangular configuration of the flange 48 as shown in FIG. 5. Thus, the end surface of the channel member 10 can abut the flat end surface 36 of the corner member 30 and the triangular flange 48 will fit within the notch 50 with the surfaces of both components flush with each other. A similar channel member 10 can be mated with the opposite side of the corner piece 30 in the same manner. The rear wall 14 of the channel member 10 as well as the triangular flange 48, may be provided with preformed holes 52 or subsequently drilled holes for the reception of nails or screws to mount the baseboard channel member and the channel piece on the wall.

Figure 6:
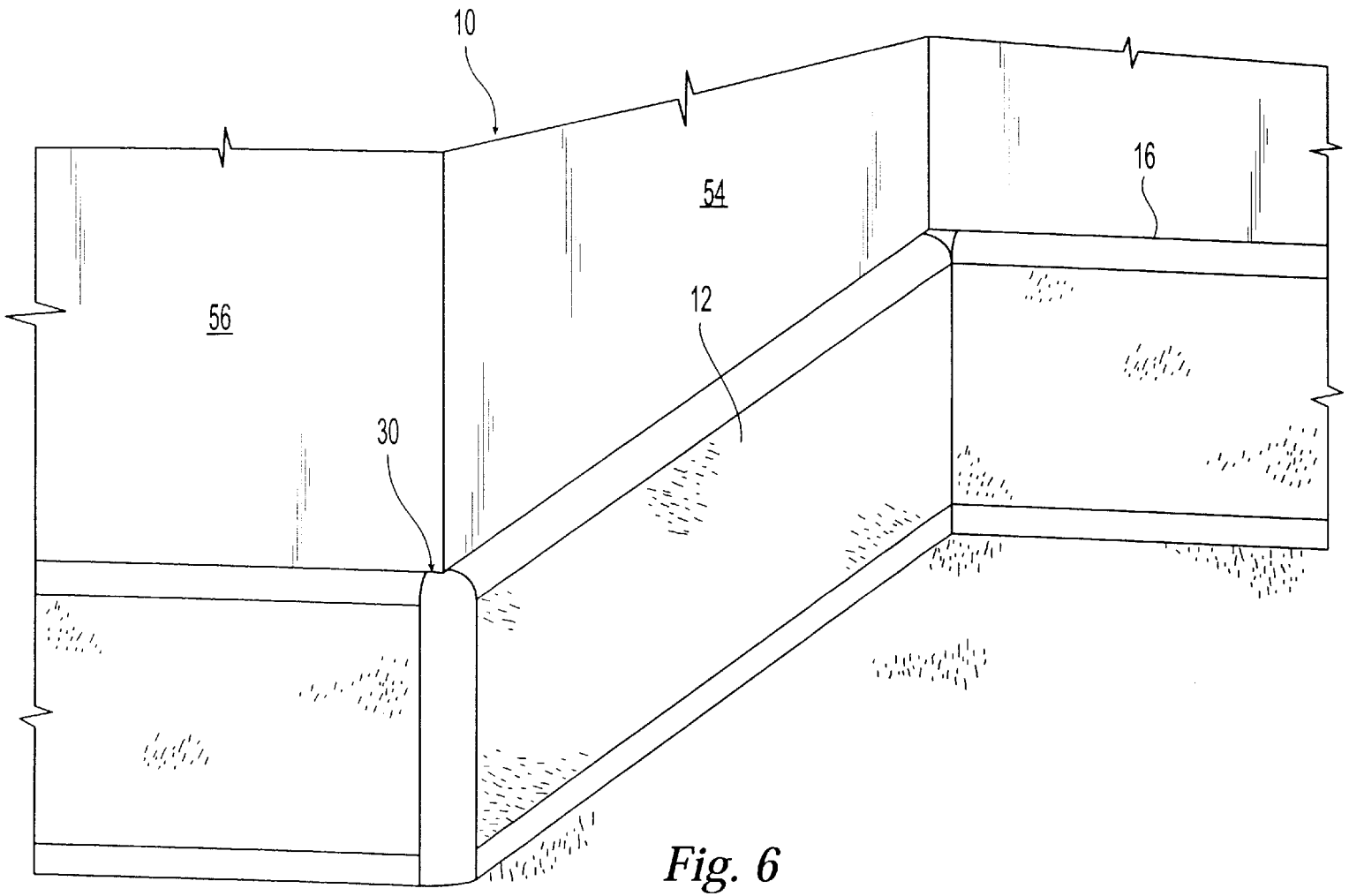
FIG. 6 is a perspective view of the baseboard channel member of FIG. 1 in combination with the corner piece of the present invention and the carpeting installed.

A finished baseboard installation is shown FIG. 6 wherein an inner corner and an outer corner are involved. The corner piece 30 is mounted on the outer corner and two baseboard channel members 10 are mounted on the walls with their respective ends disposed in flush engagement with the corner piece 30. With respect to the inner corner, the two end edges which abut each other are mitered to provide a smooth fit. It is also possible to utilize a corner piece 31 having a square cross-section as shown in FIG. 4. Carpet strips 12, which match the floor carpet, are fitted in each of the baseboard channel members.

While the preferred embodiment has been described, variations thereto will occur to those skilled in the art within the scope of the present inventive concepts which are delineated by the following claims.

What is claimed is:

1. A corner piece for use with baseboard channel members for pre-cut carpet strips, said corner piece comprising an elongated partial cylindrical member having top and bottom ends and two flat side walls disposed orthogonal to each other, an outer cylindrical surface and an inner surface defined by an elongated groove extending the length of the corner piece and having two flat walls disposed perpendicular to each other and perpendicular to said side walls respectively and a pair of flanges extending outwardly from said side walls perpendicular to each other and to said side walls with opposing surfaces of the flanges flush with said flat walls respectively for mounting said corner piece on a corner defined by two wall surfaces disposed perpendicular to each other.

2. The corner piece as set forth in claim 1, wherein said flanges each have a triangular configuration having upper and lower edges spaced from the top and bottom ends of said corner piece.

3. A corner piece as set forth in claim 2, wherein said top end has a rounded configuration blending smoothly with said cylindrical outer surface.

4. A baseboard assembly comprising at least one baseboard channel member having a flat vertically disposed rear wall and outwardly projecting upper and lower walls for retaining a carpet strip therebetween and a corner piece comprised of a partial cylindrical member having vertically disposed side walls disposed orthogonal with respect to each other, an outer cylindrical surface extending between said side walls, one of which is disposed in abutting engagement with an end of said baseboard channel member and a pair of flanges extending outwardly from the side walls of said corner piece perpendicular thereto, said baseboard channel member having a cut-out portion in said rear wall adjacent the end of said baseboard channel member, having a configuration complementary to a flange of said end piece and receiving said flange therein when said baseboard channel member and said end piece are mounted on a wall structure.

* * * * *